United States Patent [19]

Butler et al.

[11] Patent Number: 4,948,435

[45] Date of Patent: Aug. 14, 1990

[54] METHOD FOR INHIBITING STRESS CORROSION CRACKING

[76] Inventors: Thomas M. Butler, 7564 Clarence Ave., Pulaski, N.Y. 13142; David Sancic, 236 E. 6 St., New York, N.Y. 10003

[21] Appl. No.: 140,547

[22] Filed: Jan. 4, 1988

[51] Int. Cl.[5] ..... C21D 9/50

[52] U.S. Cl. ..... 148/127; 148/128; 148/154

[58] Field of Search ..... 148/127, 128, 136, 154

[56] References Cited

U.S. PATENT DOCUMENTS

| | | | |
|---|---|---|---|
| 3,567,907 | 3/1971 | Carpenter | 219/483 |
| 4,188,419 | 2/1980 | Deteit et al. | 427/287 |
| 4,229,235 | 10/1981 | Matsuda et al. | 148/127 |
| 4,354,883 | 10/1987 | Terasaki | 148/127 |

*Primary Examiner*—R. Dean

[57] ABSTRACT

Method and apparatus for inhibiting stress corrosion cracking adjacent weldments in steel workpieces such as stainless steel pipe through generation of a controllable throughwall temperature differential by exposure of one workpiece surface to externally generated radiant heat while maintaining a flow of coolant fluid past the other surface thereof.

8 Claims, 3 Drawing Sheets

FIG. 5
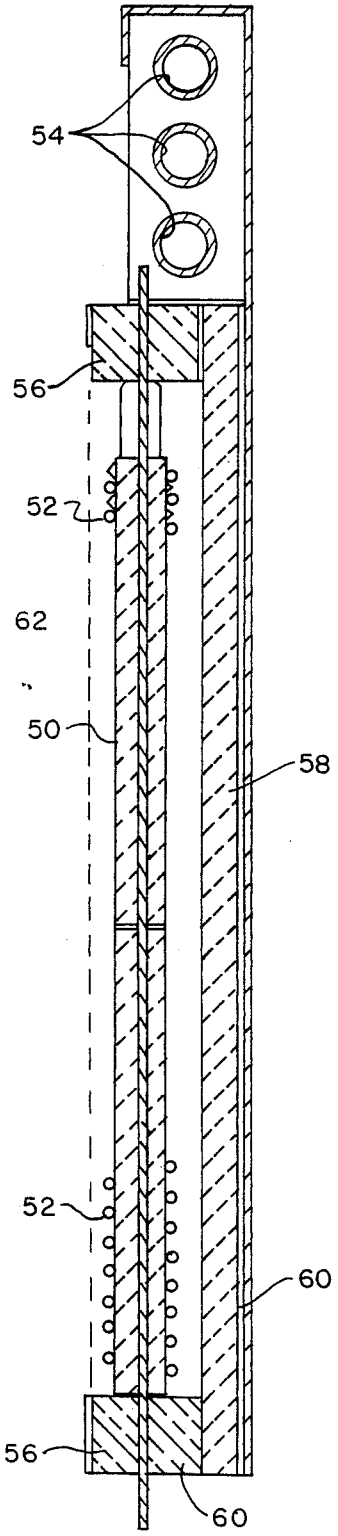
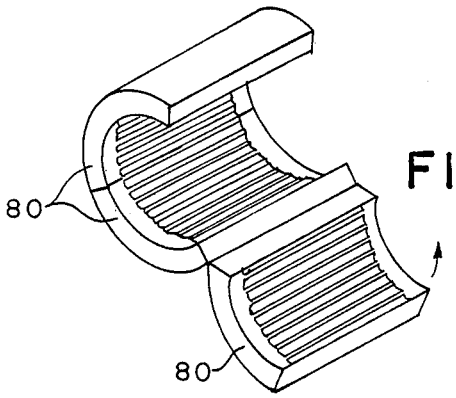
FIG. 6
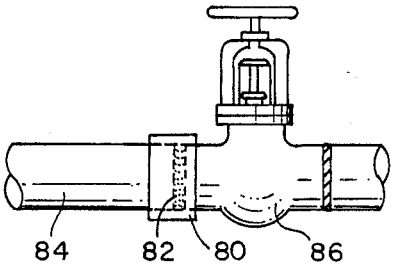
FIG. 7
FIG. 8
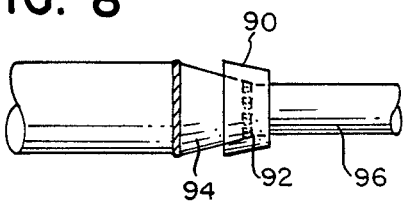
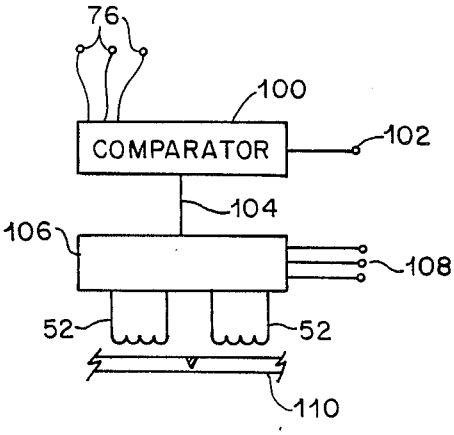
FIG. 9

METHOD FOR INHIBITING STRESS CORROSION CRACKING

This invention relates to the reduction of stress corrosion cracking in steel articles and particularly to improved method and apparatus for the in situ reduction of intergranular stress corrosion cracking in the vicinity of welded joints in austenitic stainless steel piping systems.

BACKGROUND OF THE INVENTION

Stress corrosion cracking in welded steel articles and particularly intergranular stress corrosion cracking in welded austenitic stainless steel piping is apparently attributable to the interactive presence of a corrosive environment, sensitization of the steel by welding heat, alloying element content and other metallurgical factors, and by the presence of residual tensile stresses adjacent to a weld area.

Intergranular stress corrosion cracking in steel and particularly in the vicinity of welded joints in austenitic stainless steel piping employed in nuclear power plant water lines has long been recognized as a serious problem in the art. Diverse solutions to this long standing problem have been proposed, such as the early suggestions of solution annealing, the application of overlay weld bridging extending beyond the original weld concurrent with flow of coolant fluid within the pipe as taught in the Hanneman et al U.S. Pat. No. 4,049,186 and the rapid heating of localized sensitized areas by the generation of a high frequency alternating current within the pipe by induction, or by internal [$I^2R$] resistance heating followed by a rapid liquid quenching as suggested by the Eguchi et al U.S. Pat. No. 4,168,190. More recent suggestions, advanced in light of knowledge that one significant probable cause of intergranular stress corrosion cracking in the vicinity of welded joints in nuclear power plant austenitic stainless steel piping was the existance of residual tensile stresses adjacent the joint location, have been to induction heat the pipe by the passage of current therethough intermediate a pair of electrode elements disposed in spaced relation on the outer pipe surface while coolant fluid flows through the pipe as suggested by Matsuda et al U.S. Pat. No. 4,229,235. Matsuda also pointed out that by the application of such heat, the normally existing residual tensile stress on the interior wall of the pipe could be reduced and possibly converted into a residual compressive stress with an accompanying reduction of "corrosion fatigue". More recent suggestions include the selective shaping of induction heating elements or coils to try to control the temperature distribution over the area of application as suggested by Terasaki U.S. Pat. No. 4,354,883 and Sugihura et al U.S. Pat. No. 4,505,763. Neither the use of welded overlays or the use of current flow through the pipe intermediate a pair of applied electrodes has proved to be particularly efficacious, due, at least in part, to the inherent inability to control the temperature gradients within the metal and to the localized environmental difficulties presented by in situ welding. Induction heating of the pipe, while theoretically attractive, requires as a practical matter expensive and bulky equipment such as special high frequency power supplies, impedance matching equipment, cooling media for the induction coils and power cables, and related pumping equipment as well as carefully positioned shielding, all constituting practical problems exacerbated by the complex geometry of installations at valves, tees, elbows, crossovers and the like, that require specially designed induction coil and shielding components.

SUMMARY OF INVENTION

This invention may be briefly described, in its broader aspects, as method and apparatus for effecting the in situ reduction of intergranular stress corrosion cracking in welded austenitic and other steel articles, such as stainless steel pipe, through generation of a readily controllable through-wall temperature differential by subjecting the outer surface thereof to a rapid rise in temperature by exposure to externally generated radiant heat concurrent with maintaining a flow of coolant past the inner surface thereof. In a narrower aspect, the subject invention includes modular ovenlike radiant heat generating means incorporating pluralities of high temperature radiant heating coils complementally conformable to the contour of the area to be treated in association with readily permitted selective control of such radiant heat generating coils and spacing thereof from the workpiece. In a still narrower aspect, the invention includes heat flow directing and insulating means for efficiently maximizing the transfer of generated heat to the workpiece.

Among the advantages attendant the practice of the subject invention is the provision of a markedly improved degree of control of through-wall temperature gradients with an attendant avoidance of specially designed transformers, cables, and related shielding and control equipment characteristic of induction heating apparatus. Other advantages include the elimination of cooling water and associated high frequency generating equipment and permitted use of conventional industry standard power supplies, cabling and control equipment with attendant simplification of installation and increased mobility; the elimination of undesired heat transfer to or heat generation in adjacent equipment and markedly reduced power requirements. Still further advantages include permitted application to varied pipe and component geometries and a high degree of selective control and positioning of radiant heat generating modules to control the selective application of heat to various workpiece areas to affect the desired through-wall temperature differential therethrough and consequent permitted treatment of welded joints between pipes or components of different alloys that require different heat up rates on either side of welded joint.

The object of this invention is the provision of improved method and apparatus for the radiant heat treatment of welded steel workpieces to minimize intergranular stress corrosion cracking therein.

Another object of this invention is the provision of improved method and apparatus for in situ reduction of intergranular stress corrosion cracking adjacent welded areas in stainless steel piping in nuclear power plants and the like.

Other objects and advantages of the subject invention will become apparent from the following portions of this specification and from the appended drawings which illustrate, in accord with the mandate of the patent statutes, a presently preferred embodiment of heat treating apparatus incorporating the principles of this invention.

BRIEF DESCRIPTION OF THE DRAWINGS

FIG. 5 is a sectional view, as taken on the line 4—4 of FIG. 3.

FIGS. 6 through 8 are schematic oblique views of selectively shaped radiant heating modules adapted to accomodate varying workpiece surface contours.

FIG. 9 is a schematic diagram of a power control system for a heating assembly of the type described. Referring to the drawings and initially to FIG. 1, the improved method and apparatus of this invention includes the in situ exposure of a weldment 10 and a zone on either side thereof, as indicated by the dotted line 12, at the juncture of two sections of stainless steel pipe 14 to externally generated heat 16 in an ovenlike atmosphere. Such externally generated heat 16 is initially essentially of radiant character, generated by the passage of controlled amounts of electrical current through one or more selectively sized and/or shaped radiant heat generating resistance heating wires 18 located in spaced relation to the external pipe and weld surfaces 20 concurrent with the passage of coolant fluid 30 past the interior pipe wall surface 32. Disposed in surrounding relation to the wires 18 is an ovenlike housing formed of an insulating shielding medium 22 desirably of ceramic and of radiant heat reflective character, to confine and redirect the generated heat, as indicated by the arrows 24, toward the pipe surface 20. The heat insulating and reflective shielding medium 22 is desirably backed up and supported by a rigid shell 26 having marginal side walls disposed in abutting relations with the pipe surface to complete the oven like enclosure.

Figure 2:
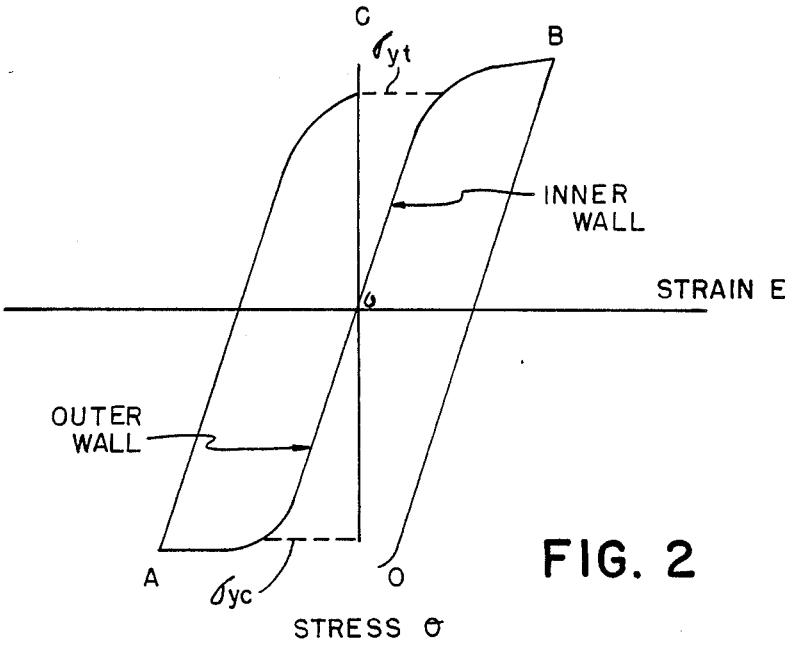
FIG. 2 is a idealized stress-strain diagram illustrative of the progressive stress modification in a welded pipe workpiece in response to the application of remotely generated radiant heat thereto in the presence of cooling water flowing therethrough, followed by subsequent cooling.

The application of the externally generated heat to the external pipe surface within the zone 12, in conjunction with the continued flow of coolant fluid 30 through the pipe interior and adjacent the inner wall 32 thereof, serves to desirably develop a through-wall temperature differential gradient of appropriate character to develope sufficient thermally generated outer wall plastic deformation to create a stress greater than the materials compressive yield stress thereat and a stress greater than the materials tensile yield stress at the inner wall surface thereof. Such phenomena is depicted in FIG. 2 in idealized condition where the tensile and compressive yield strengths are represented by $\sigma yt$ and $\sigma yc$ respectively. The outer surface of the pipe is heated to establish a through-wall temperature differential of the appropriate magnitude to create a stress-strain distribution on the outer surface of the pipe that follows curve OA and a stress-strain distribution on the inner surface of the pipe that follows curve OB. As indicated, the temperature differential is of such character to provide an outer wall temperature of a magnitude to create a localized thermal stress in excess of the pipe material's compressive yield stress on the outer surface and in excess of the materials tensile yield stress on the inner surface thereof as represented by the points A and B. When the externally generated radiant heat is stopped and the pipe permitted to return to ambient temperature, the stresses in the inner and outer surfaces are transformed via curves BD and AC into a residual compressive stress on the inner surface and a residual tensile stress on the outer surface of the pipe. The reduction of the tensile stress state and desirably the conversion thereof into a residual compressive stress state on the inner pipe surface in the vicinity of the welded joint renders such area more resistant to stress corrosion and/or corrosion fatigue and operates to reduce intergranular stress corrosion cracking at such location.

Figure 1:
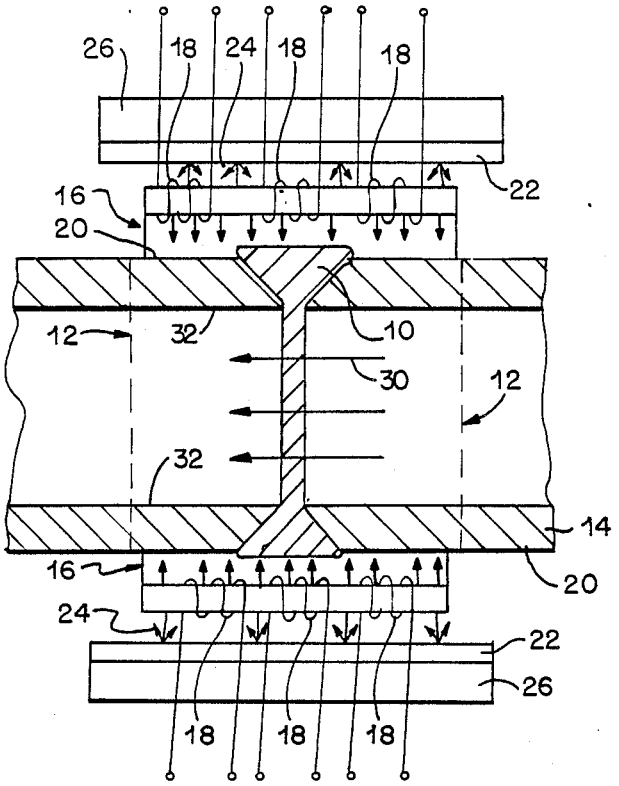
FIG. 1 is a schematic sectional view illustrative of the practice of the invention in the treatment of a welded joint in stainless steel piping as employed in nuclear power plants.
Figure 3:
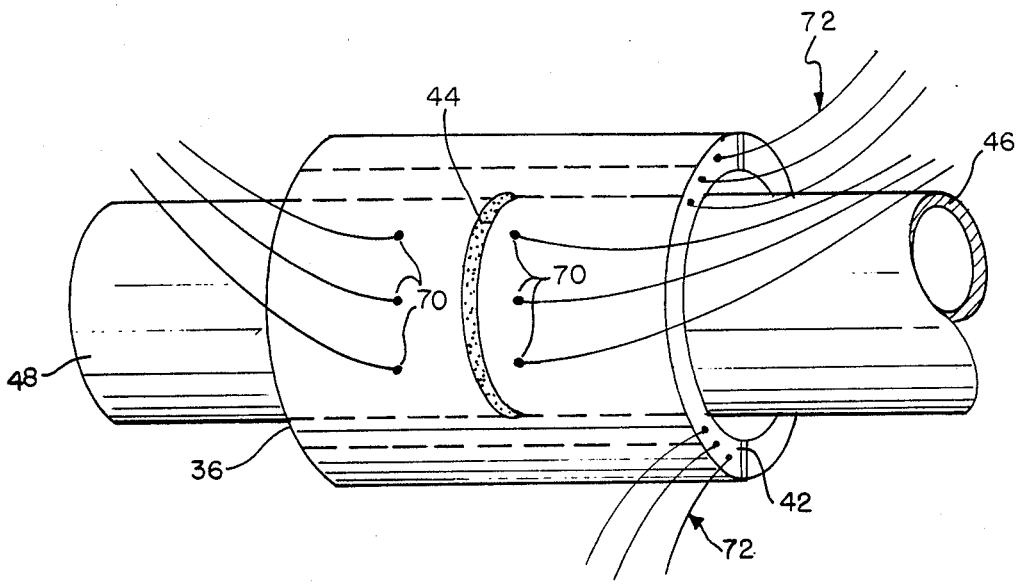
FIG. 3 is a schematic oblique view of the application of a radiant energy heating element to the weldment area of a stainless steel pipe in accord with the principles of this invention.
Figure 4:
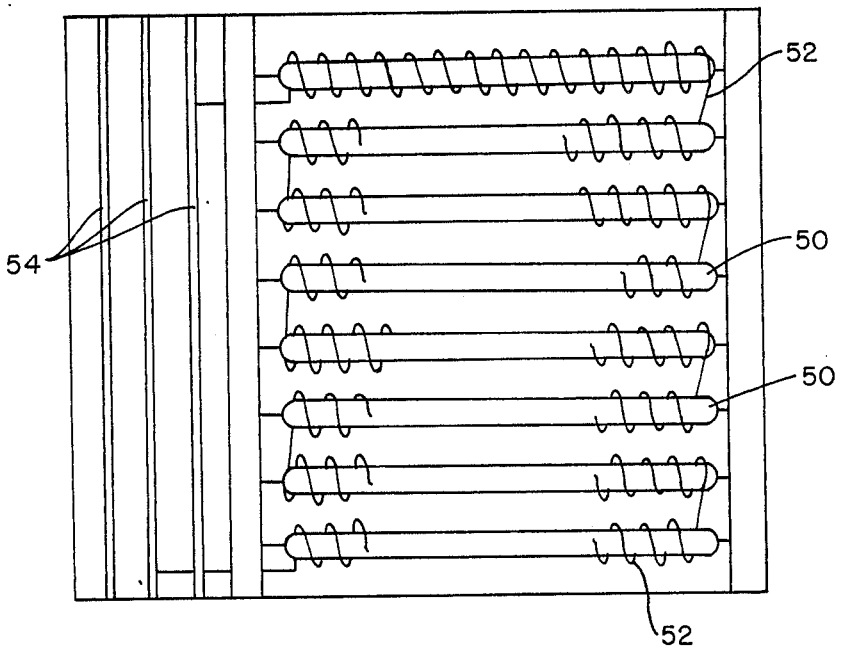
FIG. 4 is a sectional view, as taken on the line 3—3 of FIG. 2 of a portion of a radiant heating module incorporating the principles of this invention.

As pointed out earlier, the utilization of a radiant heat source disposed within an ovenlike housing in spaced relation to the workpiece surface permits the external heating elements to be constructed in modular forms of different shapes in order to accommodate welded joints at varying locations. One of the most widely found locations for a welded joint is intermediate two lengths of pipe as generally depicted in FIG. 1. Referring now to FIG. 3–5, there is illustrated an assembled cylindrical shell type heating element assembly generally designated 36 and made up of, a plurality, i.e., at least two segments 40 and 42 of a length sufficient to extend on either side of weld 44 joining two sections of straight stainless steel pipe 46, 48. As best shown in FIG. 4 and 5 each of the partial cylindrical segments includes a plurality of elongate non-conducting ceramic support members 50 having radiant heat generating resistance heating wires 52 coiled thereabout and terminally connected to bus bars 54 carrying, for example 480 volts of 3 phase A.C. power. The ceramic support members 50 are terminally supported and maintained in predetermined spaced relation with each other by shell insulators 56 and are backed by a radiant heat reflective wall 58, suitably also of high temperature ceramic material. The entire assembly of the bus bars 54, shell insulators 56 and reflective wall 58 are surrounded on three sides by a stainless steel housing 60. As best shown in FIG. 5, the shell insulators 56 are transversely diminsioned so as to position the resistance heating wires 52 in closely spaced but separated relation with the exterior surface of the pipe, as indicated by the dotted line 62 and to also serve as end walls in the oven like enclosure. As schematically depicted on FIG. 3 a plurality of thermocouples 70 are desirably mounted on the exterior surface of the pipe section 46 and 48 to provide a continuous flow of temperature information as to actual temperature at the pipe surface and thereby permit a ready control of heating rates. Power cables 72 serve to provide electrical power to the bus bar 54 and appropriate power rheostats, not shown, regulate the amount of power supplied thereto.

FIGS. 6 through 8 schematically depict various weld location geometries in piping sections and the ready adaptation of modular radiant heating assemblies thereto.

FIG. 6 for example schematically depicts a cylindically shaped heating assembly made up of three 120° sections 80. FIG. 7 schematically depicts the mounting of an assembly of the type shown in FIG. 6 over one of the weldments 82 interconnecting a straight pipe section 84 to a valve 86 in the general form of a "Tee" joint. FIG. 8 shows a tapering heating assembly 90 mounted over a weld 92 intermediate a reducer transition pipe section 94 and a reduced diameter pipe section 96. In an assemblage of this type on set of radiant heating elements will be disposed in parallel spaced relation with the surface of the reducer section 94 and a second set of heating elements will be disposed parallel to the surface of the pipe 96.

FIG. 9 is a schematic depiction of a system for controlling the rate of heat application to the outer surface of the workpiece 110. As shown the thermocouples 70 feed a continuous stream of temperature data, indicative of workpiece outer surface temperature, to a comparator unit 100 which also continuously receives data, through sensor 102, of the coolant water temperature flowing past the inner surface of the workpiece. Such input data is compared with preprogrammed data values indicative of desired temperatures on a finite time base and the differences therebetween are utilized to provide a series of control signals 104 to a power control unit 106 for regulating the amount of power supplied to the radiant heating elements 52 from an external power source 108.

As will be apparent, the foregoing described modular form of construction can not only accomodate differing workpiece contours but also provides for the readily controlled application of heat to the workpiece and to portions thereof. As such the disclosed construction readily can accommodate metals having differing coefficients of thermal expansion and provide adequate, yet different through-wall temperature differentials in each alloy and/or appropriate temperature differentials longitudinally of the pipe adjacent to the weld area. As will now also be apparent, radiant heating elements other than the heretofore described resistance wires could be employed for certain installations and areas of treatment as for example, high energy lamps employing quartz filaments or other high temperature ceramic or metal-ceramic mixtures as radiant heating elements.

Having thus described our invention, we claim:

1. A method for the inhibition of intergranualar stress corrosion cracking adjacent to a welded joint in an austenitic stainless steel workpiece, comprising the steps of selectively subjecting a first surface of said welded joint and the workpiece areas adjacent thereto that are normally subject to localized residual compressive stress to radiant heat emanating from an external source of radiant heat disposed in closely spaced proximity thereto, maintaining a flow of cooling fluid past a second surface of said welded joint disposed in spaced relation with said first surface and the workpiece area adjacent to said second surface that are normally subject to localized residual tensile stress, regulating the quantum of applied radiant heat and the quantum of said cooling fluid to create a temperature differential across said first and second surfaces of said welded joint and the workpiece areas adjacent thereto of a magnitude sufficient to create a localized thermal stress in excess of the localized residual compressive yield stress on said first surface and areas adjacent thereto and in excess of the localized residual tensile yield stress on said second surface and areas adjacent thereto, and cooling said first and second surfaces of said welded joint and areas adjacent thereto to ambient temperature to markedly reduce the magnitude of the residual compressive stress on said first surface and workpiece areas adjacent thereto and to markedly reduce the magnitude of the residual tensile stress on said second surface and workpiece areas adjacent thereto.

2. A method as set forth in claim 1 wherein said source of radiant heat is disposed in an ovenlike enclosure surrounding said first surface of said welded joint and the areas adjacent thereto.

3. A method for the inhibition of intergranular stress corrosion cracking adjacent to a welded joint in an austenitic stainless steel pipe system subject to high pressure and high temperature operating conditions comprising the steps of maintaining a flow of cooling fluid within said pipe past the inner surface of said welded joint and the pipe surfaces immediately adjacent thereto, subjecting the outer surface of said welded joint and the pipe surface areas immediately adjacent thereto to radiant heat emanating from an external heat source disposed in closely spaced proximity thereto, regulating the quantum of applied radiant heat and the quantum of the cooling fluid flow to create a temperature differential across the pipe wall of a magnitude sufficient to create a localized thermal stress in excess of the pipe's compressive yield stress on the outer weld surface and pipe surfaces immediately adjacent thereto and in excess of the pipes tensile yield stress on the inner weld surface and pipe surface immediately adjacent thereto, and cooling the inner and outer surface of said welded joint and the pipe surfaces adjacent thereto subject to said radiant heat to ambient temperature to markedly reduce the magnitude of the residual compressive stress on the outer surface of said welded joint and the outer pipe surface adjacent thereto and to markedly reduce the magnitude of the residual tensile stress on the inner surface of said welded joint and the inner pipe surface adjacent thereto.

4. The method as set forth in claim 3 wherein said radiant heat source is disposed within an ovenlike enclosure effectively surrounding said welded joint and the outer pipe surfaces adjacent thereto.

5. The method as set forth in claim 3 wherein said heat source comprises resistance wire heatable to incandescence by passage of electrical current therethrough.

6. The method as set forth in claim 3 wherein said radiant heat comprises both direct and reflected radiant heat emanating from said heat source.

7. The method as set forth in claim 1 wherein said created temperature differential across said first and second surfaces of said welded joint and the workpiece areas adjacent thereto is of a magnitude to provide, upon subsequent cooling to ambient temperature, a localized residual compressive stress on said second surface and the workpiece areas adjacent thereto and a localized residual tensile stress on said first surface and the workpiece areas adjacent thereto.

8. The method as set forth in claim 3 wherein said created temperature differential across the pipe wall is of a magnitude to provide, upon subsequent cooling to ambient temperature, a localized residual compressive stress on the inner surface of the welded joint and inner pipe surface adjacent thereto and a localized residual tensile stress on the outer surface of the welded joint and outer pipe surface adjacent thereto.

* * * * *